United States Patent [19]

Kirby et al.

[11] 3,986,717

[45] Oct. 19, 1976

[54] METHOD AND APPARATUS FOR STARTING A MODEL VEHICLE ON A RACE TRACK

[75] Inventors: James S. Kirby, Huntington Station; Louis Accornero, Hempstead, both of N.Y.

[73] Assignee: Aurora Products Corporation, West Hempstead, N.Y.

[22] Filed: Jan. 31, 1975

[21] Appl. No.: 546,106

[52] U.S. Cl. ..... 273/86 B; 46/1 K

[51] Int. Cl.[2] ..... A63F 9/14

[58] Field of Search ..... 273/86 R, 86 B; 46/202, 46/243 LV, 243 P, 1 K, 251, 257; 104/60

[56] References Cited

UNITED STATES PATENTS

| | | | |
|---|---|---|---|
| 3,339,923 | 9/1967 | Nadolny | 273/86 B |
| 3,471,963 | 10/1969 | Tomiyama | 46/243 LV |
| 3,674,269 | 7/1972 | Cooper et al. | 273/86 R |
| 3,789,540 | 2/1974 | Convertine et al. | 46/202 |
| 3,803,756 | 4/1974 | Strongin | 46/202 |

*Primary Examiner*—Anton O. Oechsle
*Attorney, Agent, or Firm*—Amster & Rothstein

[57] ABSTRACT

A method and apparatus is provided for simultaneously starting a plurality of model vehicles on a race track section constructed and arranged to be interconnected with adjacent track sections. The model vehicles are normally powered over the race track running surface by their driving wheels and are directed along the running surface by guide pins which are attached to the vehicles and which are inserted within recessed guide grooves within the race track. The vehicles are restrained from movement along the running surface by stop members which block the movement of the guide pins through the guide grooves. The model vehicles are simultaneously permitted to commence movement along the running surface of the track section by the stop members being simultaneously removed from blocking the pins of the vehicles thereby accurately simulating a racing start.

7 Claims, 7 Drawing Figures

METHOD AND APPARATUS FOR STARTING A MODEL VEHICLE ON A RACE TRACK

The present invention relates generally to model racing vehicles and, in particular, to track sections for use therewith.

Of recent times, model vehicles racing systems have become increasingly popular in which miniature electric powered versions of race cars, stock cars and such diverse other vehicles as vans and exotic-fueled vehicles are raced over a simulation of a race track. In most instances, the model vehicles are either raced singly around a pre-established course on a road bed which simulates a street or highway or are raced against each other with the speed of each vehicle being controlled by the operator manipulating a speed control device.

Usually, these model vehicle race systems are electrically powered with the vehicles' drive wheels powered by electric motors connected thereto and receiving electricity through contact with conductors located within the road bed.

The model vehicles are typically guided over the running surface of the road bed by some guide means, usually a pin which is attached to and protrudes downwardly from the model vehicle and which is directed by, for example, a groove within the road bed or track.

From the time of the first introduction of model vehicles in miniature form accompanied by track simulations, the sport of model vehicle racing has undergone an evolution to the point where heightened realism and increased performance has come to be expected and demanded by the purchasing public.

In an effort at increasing the realistic appearance of the road bed or track simulation, both the guide means and the electrical conductors which are to be contacted by the electrical contact means contained within the model vehicles are concealed within the road bed.

In addition to supplying individual like-configured track sections which are constructed and arranged to be interconnected to present substantially continuous electrical contact and a continuous guide-groove from one track section to the other, entire race-courses simulating the multitude of turns, spirals, S curves and banked turns are provided in an effort to meet the public's demand for ever-increasing realism and variety in model vehicle race courses.

While the numerous model vehicle race track sections and accessories currently in the market are generally satisfactory and provide an ample measure of realism and excitement, one of the features of many races run between full-sized vehicles has been incapable of duplication in model vehicle race tracks. That feature is the quick or "drag racing" start. In such a start, rather than beginning a race by starting up the vehicle's engines and beginning to speed down the race course as soon as the engines are started, the vehicle's engines are started and maintained at a high number of revolutions per minute, in gear, with the clutch disengaged. Upon a given signal, the clutch on each of the race vehicles is engaged and they travel down the track at a high rate of speed, starting off much more rapidly than if the race were to have begun from a complete standstill with the engines not started.

In addition to the lack of the ability of previous model vehicle race track systems to simulate the above-noted type of start, it has been a constant source of argument between users of such model vehicle race track systems as to whether one or the other of said users started its respective vehicle before the other in violation of the rules of fair play.

It matters not that such a violation, if it occurred, may have been through inadvertence or overzealousness. The fact remains that even if an actual "early-start" violation did not occur, arguments over even an imagined occurrence thereof have been a source a friction between friends competing with model race track systems, thereby detracting from complete enjoyment of the systems.

Finally, with the model vehicle race track systems heretofore available in the market, it has been impossible for a single user of such a system to effectively, repeatedly conduct time trails of individual vehicles about the race course owing to the difficulty, if not impossibility, of repeatedly, reliably starting a model vehicle on its journey about the race course from other than a standing start with the engine not operating.

It is therefore an overall object of the present invention to provide a method and apparatus for reliably, repeatedly starting one or for simultaneously starting a plurality of model vehicles moving on the running surface of a model vehicle race track.

Substantially all of the aforementioned difficulties encountered in being unable to control the method of starting model vehicles on model vehicle race tracks from other than a stopped position can be overcome by provision of an apparatus and method for maintaining operating model vehicles, with their drive wheels turning, stationary until a predetermined time when they are permitted to travel along the race track.

Accordingly, it is a more particular object of the present invention to provide a track section for model vehicles constructed and arranged for interconnection with like adjacent track sections usable in the method of maintaining operating model vehicles stationary, cancelling any forward movement thereof until a predetermined time, and thence permitting the model vehicles to be propelled along the track section.

In an illustrative embodiment demonstrating certain aspects and features of the present invention, a track section is provided for interconnection with adjacent track sections comprising an elongated track section body having a running surface and at least one longitudinally extending guide means for directing a model vehicle with respect to said running surface. An improvement is provided comprising model vehicle starter means mounted in operative relation to said track section for use in controlling the commencement of movement of a model vehicle over said track section running surface by selectively permitting said model vehicle to move over said track section running surface. Said starter means includes model vehicle stop means for selectively preventing movement of said model vehicle along said track section running surface. Means mount said model vehicle stop means for movement between a normal position and an extended position relative to said track section. Said model vehicle stop means and said mounting means are constructed and arranged relative to said track section to permit virtually unrestricted movement of said model vehicle relative to said track section upon said model vehicle stop means being in said normal position. Means are provided for selectively moving said model vehicle stop means from said normal position to said extended position relative to said track section to prevent forward movement of said model vehicle relative to said track section.

The above brief description as well as further objects, features and advantages of the present invention will be more fully understood by reference to the following detailed description of a presently preferred but nonetheless illustrative embodiment in accordance with the present invention, when taken in conjunction with the accompanying drawing, wherein.

Figure 1:
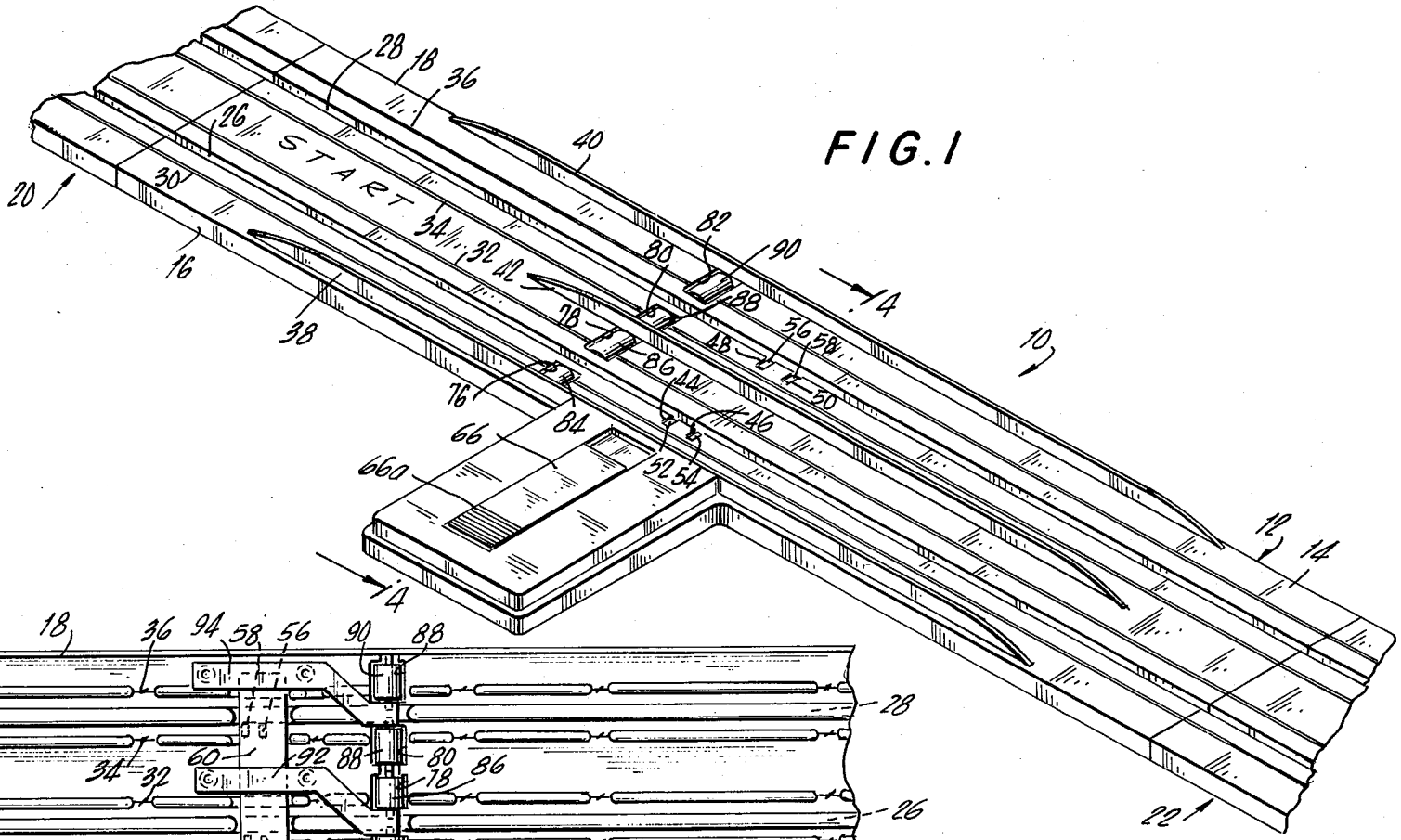
FIG. 1 is a top perspective view of a track section embodying a representative form of the present invention.

Referring now specifically to the drawing and first to FIG. 1, there is shown an illustrative track section embodying objects and features of the present invention, generally designated by the reference numeral 10. The track section 10 includes a generally flat, longitudinally extending body 12 which may be formed of insulating material by any conventional method, such as by being molded of plastic.

The track section body 12 may be of any shape or configuration. However, for simplicity of description and use, the track section 10 and its body 12 are shown as being of a generally straight, elongated configuration having a substantially flat, elongated top wall 14 which serves as a running surface with upstanding longitudinally extending side walls 16, 18 depending therefrom.

While not specifically shown in the drawing of the present invention, the track section 10 is constructed and arranged for interconnection with like adjacent track sections 20, 22 (see FIG. 1) for use in fashioning an entire race circuit or course. See, for example, the track sections shown in U.S. Pat. Nos. 3,830,426 or 3,854,405 assigned to the assignee of the present invention, the teachings of which are incorporated herein by reference.

The track section body 12 includes, in addition to the running surface 14 which is substantially plane, two longitudinally extending, upwardly facing guide grooves or channels 26, 28 which are formed within the track section. The guide grooves 26 have substantially parallel side walls and extend longitudinally for the entire length of the track section 10 opening through the running surface 14 thereof and through end walls at either longitudinal termination of the track section.

Elongated conductor strips 30, 32, 34, 36 are recessed within grooves in the track section body 12 and project upward slighly above the running surface 14 of the track section. The conductor strips 30, 32, 34, 36 project above the running surface 14 in order to be able to bear against contact strips C of a model vehicle $V_1$ or $V_2$ (see FIGS. 3 and 6). The contact strips C are used to supply electrical energy to motors of the vehicles $V_1$, $V_2$ in the conventional manner for use in turning the drive wheels D of the vehicles.

Both the guide grooves 26, 28 and the conductor strips 30, 32, 34, 36 of the track section 10 are constructed and arranged in a conventional and well-known manner to align and interconnect, respectively, with like guide grooves and conductor strips of like-adjacent track sections 20, 22. In this manner, continuous electrical contact is maintained between respective elongated conductor strips from one track section to another; and, a guide pin P affixed to a model vehicle $V_1$ or $V_2$ which is placed in directing or guiding relation with a guide groove, is guided from one track section to a like adjacent track section to direct the vehicle from one track section to a like adjacent track section under power of the driving wheels D.

Longitudinally extending lane guide rails 38, 40 are fixed proximate the opposite sides of the transverse outermost extent of the majority of the track section 10 and extend a short distance above the running surface 14. A single, central lane guide rail 42 is somewhat shorter longitudinally than the rails 38, 40 and is located approximately medially of the outer rails 38, 40, all to aid in maintaining model vehicles on the track section running surface 14.

Two longitudinally spaced transversely extending recesses 44, 46 (see FIGS. 1 and 3) appear within the body 12 of the track section 10 and open through the running surface 14 thereof at a point proximate the mid-point of the longitudinal extent of the track section 10. The recesses 44, 46 also open through one of the parallel side walls of the guide groove 26. A similarly spaced, configured and located pair of recesses 48, 50 open through the running surface 14 and one of the parallel side walls of the guide groove 38 (see FIGS. 1 and 3).

Figure 2:
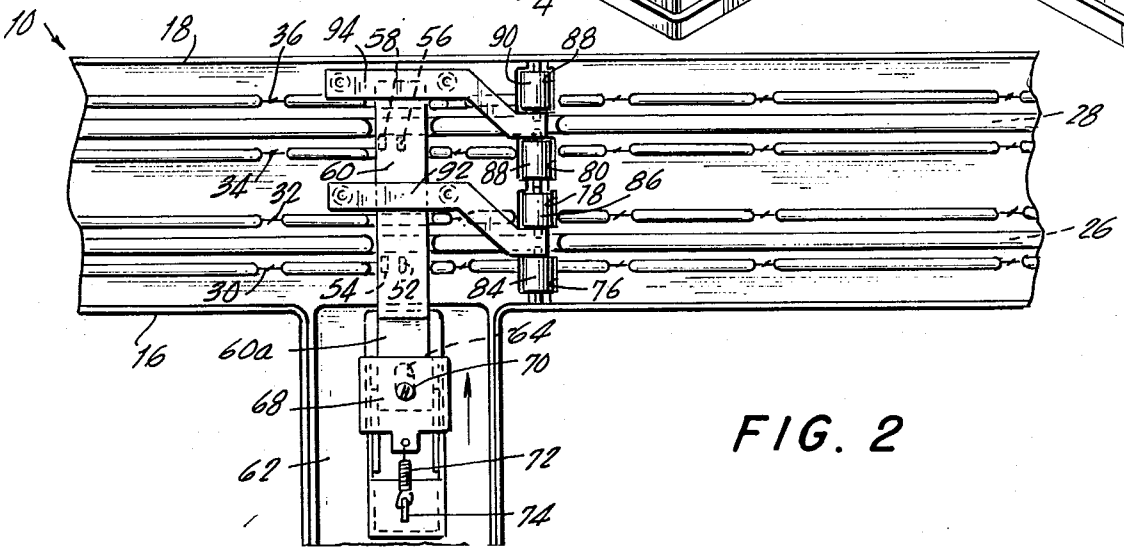
FIG. 2 is a fragmentary bottom plan view of the track section of FIG. 1.
Figures 3, 4, 5, 6, 7:
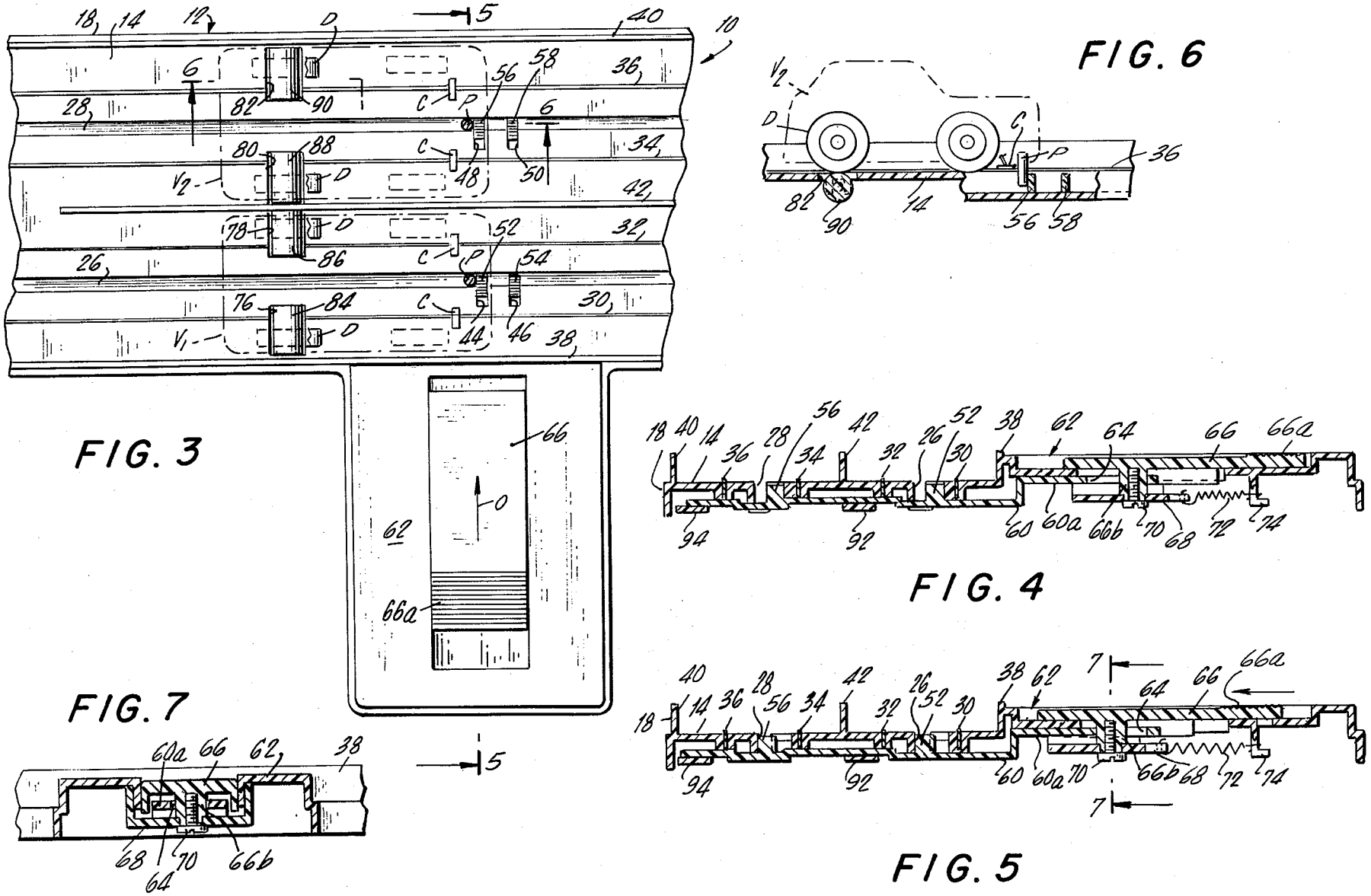
FIG. 3 is a fragmentary top plan view, on an enlarged scale, of the track section of FIG. 1 showing, in phantom, the outline of two model vehicles in place thereon, with a model vehicle stop means shown extending toward the position for stopping a model vehicle.
FIG. 4 is a sectional view, on an enlarged scale, taken substantially along the line 4—4 of FIG. 1, and looking in the direction of the arrow showing the vehicle stop means in the normal position permitting virtually unrestricted movement of a model vheicle along the model vehicle race track.
FIG. 5 is a sectional view taken substantially along the line 5—5 of FIG. 3 and looking in the direction of the arrows, is similar to FIG. 4, with the model vehicle stop means shown in the extended or blocking position.
FIG. 6 is a sectional view taken substantially along the line 6—6 of FIG. 3 and looking in the direction of the arrows, showing a model vehicle, partially in phantom, in place thereon; and, FIG. 7 is a fragmentary sectional view taken substantially along the line 7—7 of FIG. 5 and looking in the direction of the arrows.

Four lugs, 52, 54, 56, 58, are arranged in two sets of spaced pairs and are affixed to and project upwardly from a lug-operating arm 60 (see FIGS. 2, 4 and 5). The lug-operating arm 60 is configured to underlie the bottom of the body 12 of the track section 10 and includes a segment $60_a$ offset with respect thereto which underlies a platform 62 which extends transversely with respect to the track section 10 as may be seen by reference to FIGS. 1, 2, 3, 4 or 5. The platform 62 includes an upper surface and side walls depending therefrom and is shown in the preferred embodiment as being fixed to a depending side wall of the main track section 10.

The recesses 44, 46, 48, 50 are of a given transverse extent; and, the lugs 52, 54, 56, 58 are constructed and arranged to longitudinally mate with and be transversely shorter than the respective recesses 44, 46, 48, 50. The respective lugs and recesses are so configured that the recesses are spaced relative to the guide grooves 26, 28 and are sized to permit the lugs to be contained therein in a "normal" position retracted within the recesses and not projecting into the respective guide grooves 26, 28 (see FIGS. 1 and 4).

As may be seen by reference to FIGS. 1 and 3, the lugs 52, 54, 56, 58 are all transversely oriented on the operating arm 60 relative to the track section 10. In addition, lugs 52 and 54 (and lugs 56 and 58) are longitudinally aligned and longitudinally spaced from one another a given distance. Further, the lugs 52 and 56 (and the lugs 54 and 58) are transversely spaced from one another a distance approximately equal to the transverse distance between guide grooves 26 and 28.

The lugs 52, 54, 56, 58 are so configured and sized that they are capable of transverse movement relative to the track section 10 within the respective recesses 44, 46, 48, 50, that they can be moved to an "extended" position to project into the guide grooves 26, 28 and effectively block passage of a guide pin P through the respective guide grooves 26, 28 (see FIGS. 3, 5 and 6).

The lug-operating arm 60 and its offset segment $60_a$ are configured and arranged to permit movement thereof in a transverse direction relative to the track section to permit the aforementioned movement of the lugs 52, 54, 56, 58 within the respective recesses from the normal to the extended position. The offset segment $60_a$ of the lug-operating arm includes a slot 64 therein which is generally oval in configuration and has its longer axis aligned with the transverse direction of movement of the offset segment $60_a$ (see FIGS. 2, 4 and 5).

A lug operating arm actuator 66 extends generally transversely relative to the track section 10 and is located within a transversely extending recess within the platform 62. The recess within the platform 62 is of greater transverse extent than is the operating arm actuator 66 to permit transverse movement of the actuator within the recess.

The operating arm actuator 66 includes a ridged portion $66_a$ at its transversely outermost end and includes a centrally located depending segment $66_b$. The depending segment $66_b$ is generally cylindrical and is sized to fit within the slot 64 in the offset segment $60_a$ of the lug-operating arm and is capable of transverse movement with respect thereto for a purpose to be described more fully hereinafter.

A retaining slide plate 68 includes means which slidably engage a transversely extending mounting member on the underside of the platform 62 (see FIGS. 2, 4 and 5). The slide plate 68 overrides the offset segment $60_a$ of the lug-operating arm and is fixed by a screw 70 to the depending segment **66*b* of the actuator 66 (see FIGS. 2, 4 and 5**).

The transversely outermost end of the retaining slide plate 68 is resiliently urged to the normal position transversely away from the longitudinal axis of the track section 10. A spring 72 is fixed at its transversely inner end to the transversely outermost part of the slide 68 and at its transversely outer end to an anchor 74 which depends from the underside of the platform 62 and which is spaced transversely further out from the track section than is the slide 68. The spring 72 resiliently urges the slide plate 68 and associated mechanism transversely away from the track section to the normal position thereof.

Four generally rectangular openings 76, 78, 80, 82 appear in the running surface 14 of the track section 10. The openings 76, 78, 80, 82 are arranged in transverse spaced alignement relative to the track section 10 with their longitudinal axes transverse with respect to the longitudinal axis of the track section (see FIGS. 1, 2, 3 and 6).

The rectangular openings 76, 78, 80, 82 are spaced so as to be aligned with and contact driving wheels D of vehicles $V_1$, $V_2$ which would be in place on the track running surface 14 (see FIG. 3 and 6).

THe rectangular openings 76, 78, 80, 82 are spaced to the left of a car traveling to the right on the track section 10 as seen in FIGS. 1, 3 and 6. The rectangular openings are spaced to the left with respect to the lugs 52 and 56 a distance approximately equal to the distance between the guide pin P and the axle of a vehicle $V_1$ which would be halted on the running surface 14 of the track 10 when the guide pin P abutted one of the lugs 52, 56.

As may be seen by reference to FIG. 3, if a vehicle is to be used on the track section 10 which has a longer wheel base or a guide pin P which is spaced a greater distance from the drive wheels than the vehicles $V_1$, $V_2$ shows in FIG. 3, the guide pin P would be inserted between the lugs 52, 54 or between the lugs 56, 58 to abut the lugs 54 or 58 and the rear wheels would still align with the rectangular openings' axes.

Rotatably housed within each of the openings 76, 78, 80, 82, respectively are rollers 84, 86, 88, 90. The rollers 84, 86, 88, 90 are fixed with their axes aligned and arranged transversely across the track section 10.

In order to stabilize the lug-operating arm 60 during transverse reciprocations thereof between the normal and extended positions, two offset, generally longitudially extending retainers 92, 94 underlie the operating arm 60 at two different transverse locations. The retainers 92, 94 are fixed to the underside of the track section 10 and extend generally longitudinally and in an offset manner between rollers 84, 86 and 88, 90 respectively, thereby acting as spacers therebetween (see FIG. 2).

In operation, the track section 10 is interconnected between two other, like adjacent track sections 20, 22 (see FIG. 1) in the usual manner with the guide grooves 26, 28 of the track section 10 substantially aligned with like guide grooves of the track sections 20, 22 on either side thereof and also with the conductor strips 30, 32, 34, 36 of the track section 10 interconnecting with like conductor strips of the track sections 20, 22 in order to maintain a continuous electrical connection between like adjacent track sections.

A plurality of similar track sections is formed into a complete course or circuit, and a source of electrical power is connected to the conductor strips thereof. A single vehicle $V_1$ (or two vehicles $V_1$ and $V_2$ shown in phantom in FIG. 3) is then placed with the conductor contacts C thereof touching the respective conductor strips 30, 32, 34, 36 (see FIG. 3).

When the conductor strips 30, 32, 34, 36 have a potential difference applied across them, contact of the conductor strips by the contacts C will cause the motors within the vehicles $V_1$, $V_2$ to cause the driving wheels D thereof to rotate. Normally, this rotation of the driving wheels permits the vehicles $V_1$, $V_2$ to traverse the circuit on the running surface 14 of the various interconnected like adjacent track sections.

If the actuator 66 is moved in the direction of the directional arrow 0 in FIG. 3, the depending segment $66_b$, by virtue of its interaction with the slot 64 within the offset actuating arm segment $60_a$ will move the actuating arm 60, in its entirety, against the retaining spring 72 transversely across the track section. This movement moves the lugs 52, 54, 56, 58 within the recesses 44, 46, 48, 50 out of the normal position thereof and into an extended or blocking position within the respective guide grooves 26, 28.

As long as the actuator 66 is maintained in its position proximate the tracck section 10 with the spring 72 tending to urge the assembly away from the track section by virtue of the interconnection and arrangement described hereinbefore, the lugs 52, 54, 56, 58 will remain blocking the guide grooves 26, 28.

With the lugs or blocking member 52, 54, 56, 58 blocking the guide grooves 26, 28, one or more vehicles, with their guide pins P within the guide grooves 26 or 28, will abut the lugs 52 or 56 (or for the reasons noted above, the lugs 54 or 58) and the driving wheels D will rest on the respective rollers 84, 86, 88, 90.

By virtue of the contacts C of the respective whicles $V_1$, $V_2$ contacting the respective conductor strips 30, 32, 34, 36, the driving wheels D will be provided with rotational motion by the motor within the vehicles $V_1$, $V_2$. The abutting relation which has been established between the guide pins P and the appropriate lug which has been extended into the guide grooves 26, 28, will prevent the driving wheels D from moving the vehicle, and the driving wheels D will merely rotate relatively freely against the roller with which it is in contact (see FIG. 6).

When it is determined, either for a time trial for a single vehicle or for a race between two or more vehicles, that it is appropriate to start a vehicle moving over the running surface 14 of the track 10, the pressure which has been exerted on the actuator 66 in the direction of the directional arrow 0 in FIG. 3 is released, and the spring 72 urges the retaining slide plate 68 transversely away from the track section 10.

By virtue of the depending segment $66_b$ being located within the slot 64 of the offset segment $60_a$, the entire lug-operating arm 60 moves transversely away from the track section under the influence of the spring 72.

However, due to the oval shape and size of the slot 64 relative to the depending segment $66_b$, the movement of the actuator 66 does not immediately move the operating arm 60 carrying the lugs in the same direction as the actuator 66.

Once the moving depending segment $66_b$ strikes the longitudinally outermost wall of the slot 64, it rapidly moves the lug-operating arm 60 to the right as shown in FIG. 4, thereby moving the lugs 52, 54, 56, 58 within the recesses or slots 44, 46, 48, 50 out of the extended position, back into the normal position and out of blocking position relative to the grooves 26, 28.

Once the lugs have been removed from their blocking position in the guide grooves, the driving wheels D of the vehicles $V_1$, $V_2$, at virtually the same point in time, begin moving the vehicles $V_1$, $V_2$, down the track and a simultaneous even start is assured despite some slippage with the surface of the rollers 84, 86, 88, 90.

Similarly, if an individual is timing the speed of a particular car around a circuit, the engine of the vehicle can be accelerated to a desired speed and the car released precisely when the second hand of a timing device reaches a particular convenient location.

Naturally, the present invention is also adaptable for use with more than two lanes for running model vehicles and can easily be adapted to four, six or any other convenient number.

It should be noted that the lane guide rails 38, 40, 42 aid in preventing vehicles $V_1$, $V_2$ from unnecessarily removing themselves from the track owing to slight irregularities in the surface of the driving wheels D or the operation of the rollers 84, 86, 88, 90.

As will be readily apparent to those skilled in the art, the invention described may be used in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What in claimed is:

1. In a track section for interconnection with adjacent track sections for guiding a model vehicle including an elongaged track section body having a running surface and at least one longitudinally extending guide means for directing said model vehicle relative to said running surface, the improvement comprising model vehicle starter means mounted in operative relation to said track section for use in controlling the commencement of movement of a model vehicle over said track section running surface, said starter means including model vehicle stop means for selectively preventing movement of said model vehicle along said track section running surface, means mounting said model vehicle stop means for transverse movement relative to said track section between a normal position and an extended position, said model vehicle stop means and said mounting means being constructed and arranged to permit virtually unrestricted movement of said model vehicle relative to said track section upon said model vehicle stop means being in said normal position, and means for use in selectively moving said model vehicle stop means from said normal position to said extended position transversely relative to said track section to prevent forward movement of a model vehicle relative to said track section, said guide means being recessed within said track section and being constructed and arranged to direct a pin of a model vehicle inserted therein, said model vehicle stop means including at least one blocking member being constructed and arranged to block movement of said pin through said guide means upon said model vehicle means being moved transversely from said normal to said extended position, said model vehicle starter means further including means for permitting relatively unrestricted rotation of powered drive wheels of a model vehicle proximate said running surface with a pin of said model vehicle abutting said blocking member upon said model vehicle stop means being in said extended position, and means for urging said model vehicle stop means to said normal position.

2. The invention according to claim 1, said blocking member being spaced longitudinally along said track section a given distance with respect to said means permitting relatively unrestricted rotation of said vehicle drive wheels, and a further blocking member longitudinally with a longitudinally spaced from said first-named blocking member.

3. The invention according to claim 1, said means for permitting relatively unrestricted rotation of powered drive wheels including at least one rotatable member having an axis of rotation and being mounted with said axis of rotation transversely aligned relative to said guide groove and being longitudinally spaced from said blocking member.

4. In a track section for interconnection with adjacent track sections for guiding a plurality of model vehicles including an elongated track section body having a running surface and at least two longitudinally extending transversely spaced guide means for directing respective model vehicles relative to said running surface, the improvement comprising model vehicle starter means mounted in operative relation to said track section for use in simultaneously controlling the commencement of movement of said respective model vehicles over said track section running surface, said starter means including model vehicle stop means for selectively preventing movement of said respective model vehicles along said track section running surface, means mounting said model vehicle stop means for transverse movement relative to said track section between a normal position and an extended position, said model vehicle stop means and said mounting means being constructed and arranged relative to said track section to permit virtually unrestricted movement of said respective model vehicles relative to said track section upon said model vehicle stop means being in said normal position, and means for use in selectively moving said model vehicle stop means from said normal position to said extended position transversely relative to said track section to prevent forward movement of said respective model vehicles relative to said track section, each of said guide means being recessed within said track section and each being constructed and arranged to direct a pin of a respective model vehicle inserted therein, said model vehicle stop means including at least two blocking members each being constructed and arranged to block movement of a pin of a respective model vehicle through said respective guide means upon said model vehicle stop means being transversely moved from said normal to said extended position, said model vehicle starter means further including means for permitting relatively unrestricted rotation of powered drive wheels of model vehicles proximate said running surface upon said model vehicles each being placed with a respective pin thereof in a respective guide groove abutting a blocking member with said model vehicle stop means being in said extended position, and means for urging said model vehicle stop means to said normal position.

5. The invention according to claim 4 each of said blocking members being spaced longitudinally along said track section a given distance with respect to each of said means permitting relatively unrestricted rotation of said respective vehicle drive wheels, and a further blocking member longitudinally aligned with and longitudinally spaced from each of said first-named, respective blocking members.

6. The invention according to claim 4, each of said means for permitting relatively unrestricted rotation of powered drive wheels including at least one rotatable member having an axis of rotation and being mounted with said axis of rotation transversely aligned relative to each of said respective guide grooves and each being longitudinally spaced from each of said blocking members.

7. A method for permitting at least two operating model vehicles to start moving simultaneously on a running surface of a track section having an elongated body and at least two longitudinally extending guide means recessed within said track section for directing said model vehicles with respect to said running surface, said method comprising placing operating model vehicles on said model vehicle race track running surface with a pin of each of said model vehicles in directing relation to a respective guide means of said track section, operating the drive wheels of each of said model vehicles proximate said running surface, contacting each of said pins of each of said model vehicles with a respective model vehicle stop means thereby preventing movement of each of said model vehicles relative to said running surface, permitting virtually unrestricted rotation of the drive wheels of each of said operating model vehicles while simultaneously preventing each of said model vehicles from moving relative to said running surface, selectively simultaneously removing said model vehicle stop means from contact with each of said pins of each of said model vehicles thereby selectively permitting all of said model vehicles to simultaneously commence movement along said running surface.

* * * * *